United States Patent [19]

Zur

[11] 4,127,906

[45] Dec. 5, 1978

[54] ADJUSTABLE BED-CHAIR

[76] Inventor: Henry C. Zur, 10 W. Griswold, Phoenix, Ariz. 85021

[21] Appl. No.: 705,543

[22] Filed: Jul. 15, 1976

[51] Int. Cl.[2] ..... A61G 7/10

[52] U.S. Cl. ..... 5/66; 5/68; 5/90; 297/DIG. 10

[58] Field of Search ..... 5/61–63, 5/66–69, 90, 91; 297/DIG. 10

[56] References Cited

U.S. PATENT DOCUMENTS

| | | | |
|---|---|---|---|
| 3,406,772 | 10/1968 | Ahrent et al. | 5/68 |
| 3,492,988 | 2/1970 | De Mare | 5/61 |
| 3,503,083 | 3/1970 | Barnett | 5/90 |
| 3,667,075 | 6/1972 | Ballard et al. | 5/91 |
| 3,750,200 | 8/1973 | Hirmann | 5/66 |
| 3,879,772 | 4/1975 | Pol | 5/62 |
| 3,978,530 | 9/1976 | Amarantos | 5/66 |

*Primary Examiner*—Casmir A. Nunberg

[57] ABSTRACT

An adjustable bed-chair comprising a lower supporting frame, a first horizontal panel adjustable relative to the frame, a second panel pivoted at one end to said first panel and having a central recess opening thereinto from the bottom side. A body supporting assembly comprising a back and head support pivoted to said second panel at one end of said recess, a middle support pivoted to the other end of said recess and a leg support pivoted to said middle support. The back, middle, and leg support are covered by inflatable bags and these are covered by a layer of foam material. Bellows like inflatable bags are also provided to cause movement of the back support relative to the second panel; movement of the middle support relative to the central panel; movement of the leg support relative to the central support; and movement of the first panel relative to the supporting frame. A central portion of the mattress is removable and replaced by a toilet.

16 Claims, 15 Drawing Figures

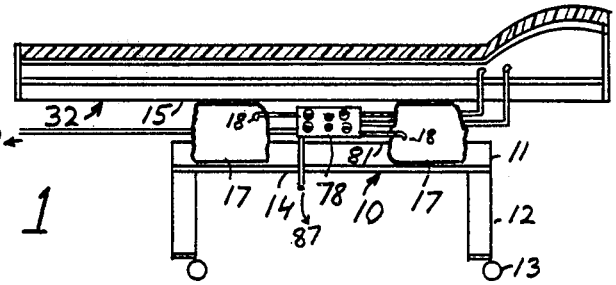
FIG. 1
FIG. 2
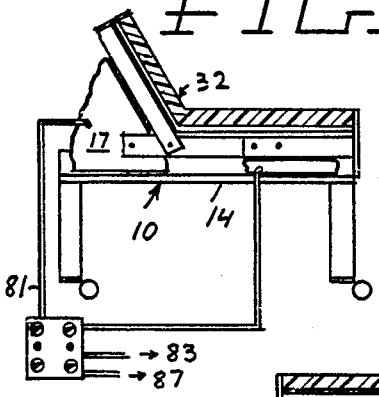
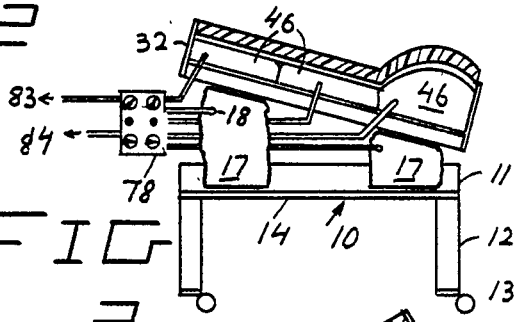
FIG. 3
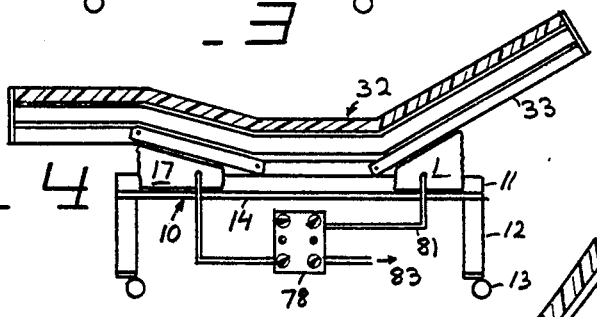
FIG. 4
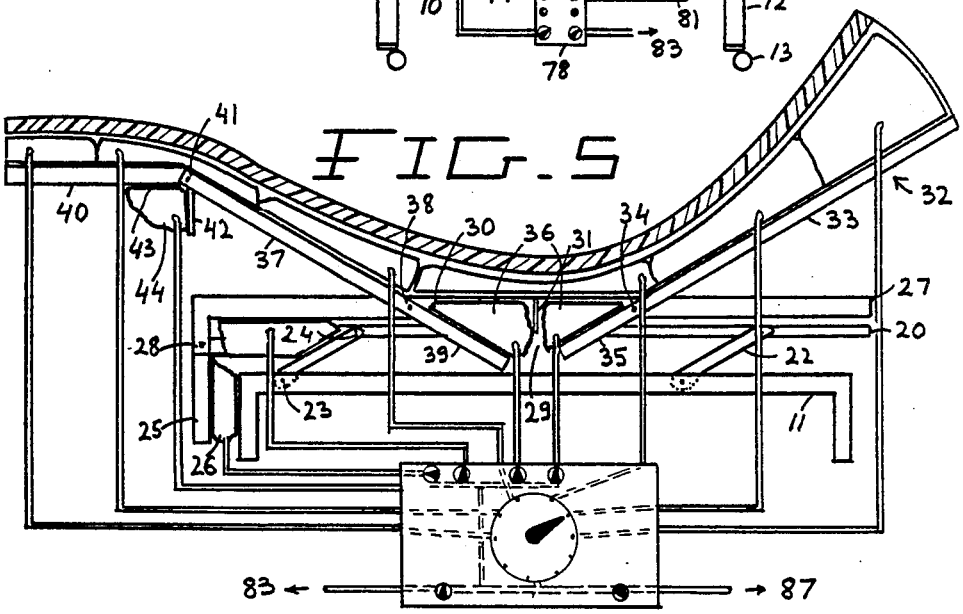
FIG. 5

FIG. 9
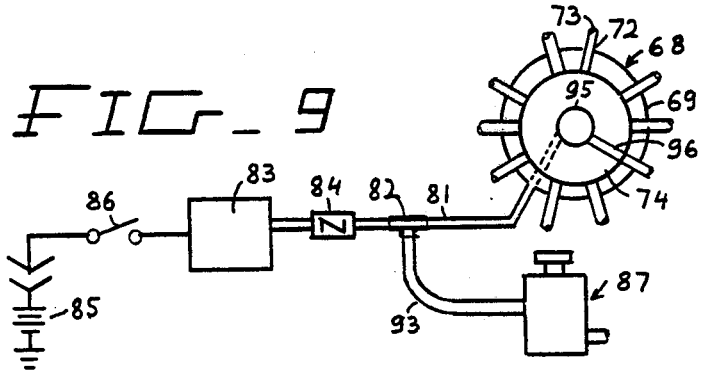
FIG. 10
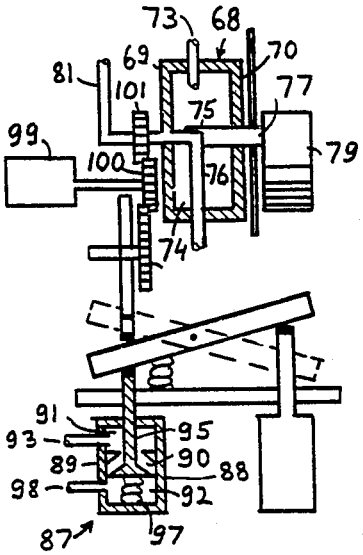
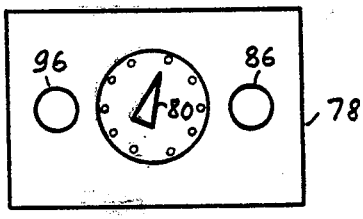
FIG. 11
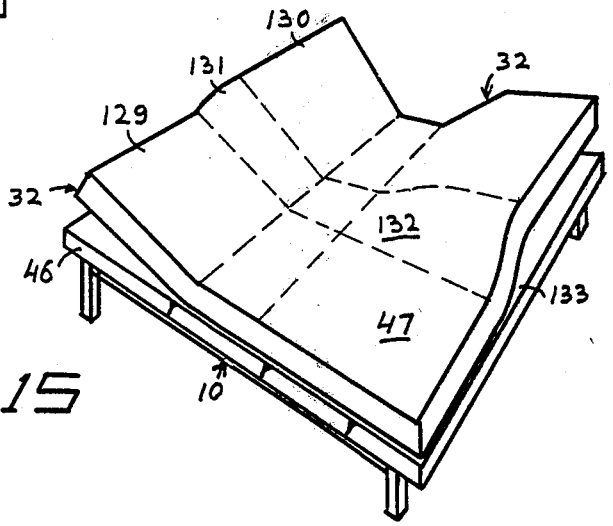
FIG. 15

FIG. 12
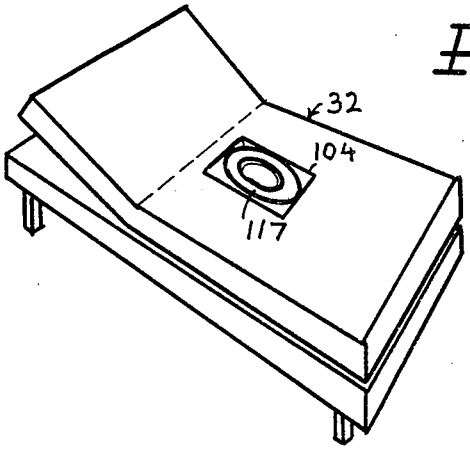
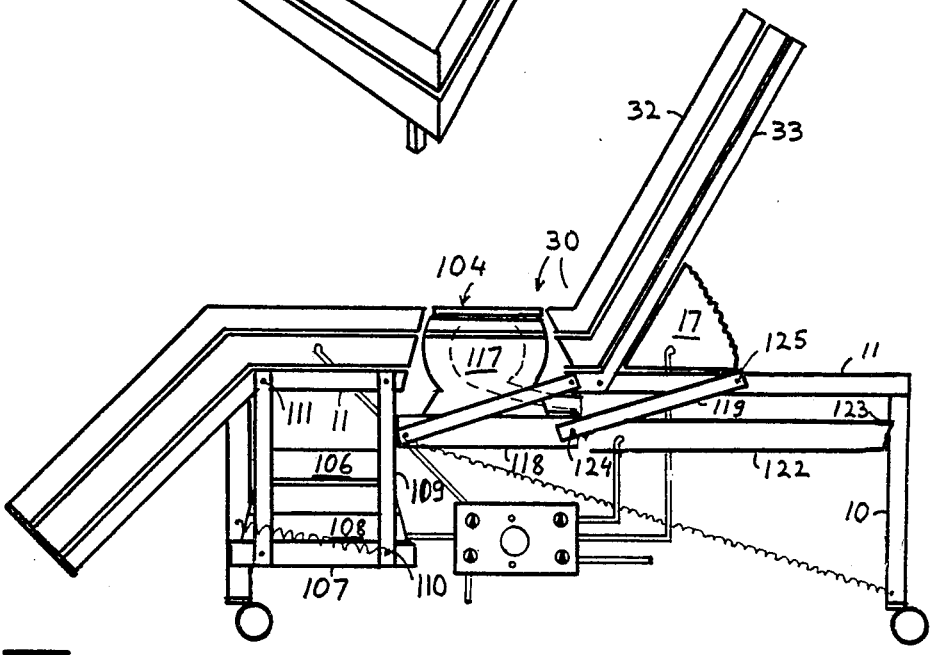
FIG. 14
FIG. 13
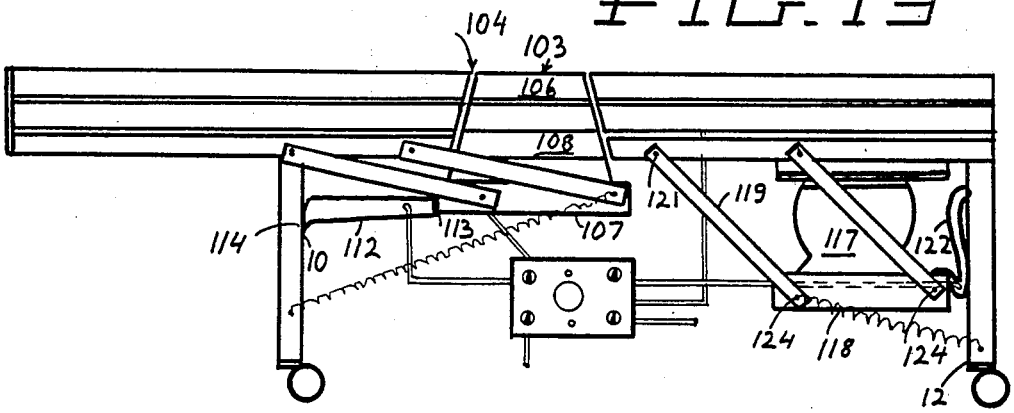

ADJUSTABLE BED-CHAIR

The present invention relates to adjustable beds and chairs which have many features in common and is concerned primarily with such a chair-bed which is adjustable to suit the comfort and needs of persons who are incapacitated, partially so, or handicapped.

BACKGROUND OF THE INVENTION

At the present time beds and chairs which are adjustable are known. Thus, it is known to provide hospital beds including a mattress support which may be raised or lowered at either end to afford a longitudinal adjustment of the mattress as an entirety. However, so far as the present applicant is aware it is not known to provide hospital beds which include mattresses the level of which may be adjusted transversely as well as longitudinally.

It is also believed that the art is singularly lacking in a mattress support comprising three longitudinal sections which are hingedly connected along transverse axes together with power means for adjusting either end section with respect to the middle section. Such an arrangement is believed to be particularly desirable in a hospital bed because in many instances a section of the bed may be adjusted to avoid the use of traction. Also, while it is known to provide a hospital bed with a space or recess to accommodate a bed-pan, the placement and removal of a bed-pan requires the services of an attendant, such as a nurse or porter. And finally, so far as hospital beds are concerned, it is not the practice to provide a mattress in the form of a plurality of inflatable bags into which air under pressure may be introduced selectively or exhausted from any bag. Such an arrangement is extremely desirable from the aspect of the comfort of the occupant of the bed.

It is known to provide a bed including a mattress comprising a plurality of inflatable bags for a single occupant, or for double occupancy but the known arrangements for double occupancy do not suit the comfort of two occupants when their size, contour, and personal dispositions are considered. This is particularly true when the mattress includes a head section which is adjustable and common to both occupants.

Adjustable chairs and particularly those of incompacitated or handicapped persons have much in common with a hospital bed and this particularly true in accordance with the present invention. It is known to provide an adjustable chair including a supporting frame and a body supporting assembly comprising three sections which are hingedly connected. These are a back support, a middle support on which the thigh portion of the occupant rests, and a leg support. Power means have been provided for swinging the back and middle supports as a rigid unit upwardly with an occupant thereon to facilitate removing his person from the chair.

Due to the weight of the average occupant this power means has taken the form of a screw stem and an electric motor. Similar power means have been provided for swinging the leg support relative to the middle support. It has been found from practical experience that such screw stems are unsatisfactory particularly when the back and middle supports are swung upwardly as a unit with an occupant thereon because of the large thrust required. If the screw stems are of a plastic it is literally impossible to provide a practically operable device of this character. The present invention proposes the use of bellows like inflatable bags to cause the swinging movements of the body supporting assembly.

It is of course known to provide chairs the back and seat of which are covered by inflatable bags, however, it is not known to provide a chair which includes both the inflatable bags which cover the seat and back and also the bellows like bags which cause the swinging movements between the body supporting assembly with a single air compressor together with a conduit system and control valve whereby air under pressure may be selectively introduced into any of the bags and exhausted therefrom.

OBJECTS OF THE INVENTION

With the foregoing conditions in mind, the present invention has in view the following objectives:

1. To provide a chassis comprising a supporting frame and a panel which is generally horizontal and spaced above the frame together with mechanism for adjusting the panel both longitudinally and transversely of the frame and which chassis is suitable for use in either a bed or a chair.

2. To provide, in a bed or chair chassis of the type noted, mechanism for achieving longitudinal and transverse adjustment which includes two inflatable bags arranged in transverse alignment at one end of the chassis and another two inflatable bags similarly arranged at the other end.

3. To provide, a chassis for a bed or chair comprising a supporting frame, a horizontal panel above the frame and connected thereto by a pair of links, together with an inflatable bag for moving the panel longitudinally and thereby vertically adjusting its position relative to the frame.

4. To provide a body supporting assembly for use in a bed or chair which includes a back support, a middle support, and a leg support which hingedly connected together, together with means for causing swinging movement of said supports relative to one another and to the frame in the form of inflatable bellows like bags.

5. To provide a mattress like assembly of a plurality of inflatable bags which may be used to cover the body supporting assembly of the bed or chair and into which air may be introduced under pressure selectively or exhausted therefrom.

6. To provide, in a bed or chair of the character aforesaid, an air compressor together with a conduit system connected to all of said inflatable bags and which includes a control valve which determines which bag is connected to the air compressor or exhaust.

7. To provide a double bed comprising two body supporting assemblies of the character above noted, means for individually adjusting the head supports on the body supporting assembly and a mattress comprising two longitudinal parts each consisting of a plurality of inflatable bags.

8. To provide a hospital bed of the type noted, which includes a central opening which is normally occupied by a removable mattress part which may be replaced by a toilet bowl.

Various other more detailed objects and advantages of the invention, such as arise in connection with carrying out the above ideas in practical embodiment will, in part, become apparent and, in part, be hereinafter stated as the description of the invention proceeds.

SUMMARY OF THE INVENTION

The foregoing objects are achieved by providing a a base which includes legs that engage the floor a frame supported by said legs and and surface members strechi-ing from one side of the frame to the other onto which 2 pairs of individually inflatable bags are positioned at opposing end sides, and a body supporting assembly resting with its bottom members on said inflatable bags. If the horizontal position of the body supporting assembly is to be changed in relation to the base, inflation and deflation of one pair of inflatable bags at a endside will affect a longitudinal adjustment of the respective side, inflation and deflation of a combination of 2 individually inflatable bags one out of each pair comprising the inflatable support at a long side, will effect a transverse adjustment of the body supporting assembly, and the inflation and deflation of the combination of all 4 bags will provide adjustment for height of the whole body supporting assembly.

Similarly, the angle of sections of a sectionally divided body supporting assembly could be adjusted by inflation and deflation of a combination of the inflatable bags on which the respective parts rest. To provide adjustment of the body supporting assembly in relation to the base combined with adjustment of the different sections of a divided body supporting assembly a panel linked to the base is interposed between the base and the body supporting assembly. The inflatable bags positioned on the base effect adjustment of the panel, and inflatable bags positioned between the panel and the back section of the body supporting assembly at its pivotal connection to a middle support mounted on said panel and between the panel and the knee support at its pivotal connection to the other side of said middle support provide for adjustment of said back and knee support relative to said middle support. An additional inflatable bag positioned at the pivotal connection of a leg support and the second side of said knee support, and supporting said leg support while resting against a member extending at a right angle downward from the knee support, causes adjustment of said leg support relative to the knee support by inflation and deflation.

It is evident that by using a combination of inflatable bags the occupant can assume a great variety of positions as may be required for comfort, for functions and for care. A continued inflation of bags positioned between the base and the interposing panel will provide a swinging movement of that panel and the body supporting assembly mounted on said panel when the panel is linked to to foot near portion of the base, and this will move the occupant into vertically elevated positions of sitting and standing up. Similarily, a deflation will cause the the position of the occupant to change from standing up to sitting, reclining and lying down.

Providing a mattress like assembly of inflatable bags over the body supporting assembly covered with a flexible layer improves the comfort of the occupant by giving adjustment of pressures at individually selected parts and when outfitted with a timer mechanism. a sequencial inflation and deflation to provide relief from pressures and their effects.

Providing the bed with a downward retracting insert and an upward moving insert with a toilet bowl operated by remote control, makes it possible for an occupant to perform the required bowl function wothout having to move for removal of a toilet cover for instalation of a toilet or bedpan, and will provide with the connected emptying ultimate sanitary conditions to hospitals and sickrooms.

In one embodiment, a second horizontal panel is pivotally mounted at one end of the first panel. This second panel is formed with a central recess which opens onto the bottom thereof and which has longitudinal open ends. A body supporting assembly is mounted on this second panel which comprises a back support which is pivotally mounted on the second panel adjacent to an open end of the recess into which it extends. A middle support is mounted on the second panel adjacent to the other open end of the recess and has a portion extending thereinto. The recess has a top back which is a part of the second panel and a central partition extending therefrom. Two inflatable bags are inserted in the chambers of the recess defined by this partition. A leg support is pivoted to the end of the middle support and is adjustable relative thereto through the medium of an inflatable bag. The back, middle, and leg supports are covered by a plurality of inflatable bags each of which may be selectively inflated or have air exhausted therefrom. These inflatable bags are covered by a layer of foam material.

In a modification the first horizontal panel which is adjustable relative to the frame is omitted and the second panel on which the body supporting assembly is mounted is pivoted directly to one end of the frame.

In a further modification which is particularly adapted for use as a bed as a bed chair chair, the body supporting assembly comprises a back support, a middle support, and a leg support having a foot rest pivotally mounted on the lower end thereof. One end of the middle support is pivoted directly to the frame with the back pivoted to the other end of the middle support. The leg support is pivoted to the middle support on the same axis which connects it to the frame. An inflatable bag between the frame and the middle support at the end of the pivotal mounting between these elements enables the middle support and back to be swung as a unit. An adjustable bag at the pivotal connection of the back support to the middle support provides for relative movement between these members and an adjustable bag between the leg support and the frame provides relative swinging movement between these members.

To selectively introduce air under pressure into the inflatable bags which cover the body supporting assembly, a conduit system and control valve is provided. Another system including an additional control valve is provided for selectively introducing air under pressure or exhausting air from any of the bellows like bags which cause relative movement between the back, middle, and leg supports and also movement of the back and middle support as a unit. Each of these conduit systems includes a compressor and an exhaust valve. The control valve is connected to either the compressor when it is in operation in which event the exhaust valve is closed, or to the open exhaust valve when the compressor is not in operation. The control valve comprises a cylinder closed at each end by an end plate in which a disc is rotatably mounted. This disc has a central bore which is connected to either the compressor or the exhaust valve. The cylinder casing is formed with a plurality of ports, each of which is connected to one of the inflatable bags. A radial passage extends from the bore of the disc and may be brought in alignment with any port in the casing by rotating the disc through the medium of an operating knob on the exterior of an end plate and which carries a pointer which cooperates with indicia on the end plate to indicate which bag is being affected.

When provided with retactable toilet the mattress is formed with a central opening which is ordinarily occupied by a mattress portion which is complemental to the opening and which is carried by a lower plate which is spaced therefrom and connected thereto by two pairs of links. The upper end of each link is connected to the panel which supports the mattress and the lower end is pivotally connected to the plate. A contraction coil spring has one end connected to the mattress supporting panel and its other end to one end of the plate. This spring normally biases the mattress portion into an out of the way position beneath the mattress supporting panel at a longitudinal end of the opening in the mattress. A flexible tubular bellows is adapted to have an expanding medium such as air or water introduced thereinto to swing the mattress part into position occupying the opening in the mattress and hold it in that position.

A toilet bowl is mounted on a second plate which is supported by two pairs of pivoted links in the manner above described in connection with the panel which supports the mattress portion. It also is normally held in an out of the way position by a contraction coil spring. It also is swung into position in which the toilet bowl occupies the opening in the mattress by a flexible tubular bellows.

For separate limb support a double bed designed for double occupancy comprises two longitudinal bed sections each of which includes a body supporting assembly comprising a head and back support, a middle support, and a leg support which are hingedly connected in the manner above described with each body supporting assembly being covered by a mattress like assembly of inflatable bags which may be selectively inflated or have air exhausted therefrom in the manner above described. This mattress like assembly is covered by a layer of foam material.

Provision is made for inflating or deflating certain of the bags of the leg supporting portions of the bed to permit the layer of foam to sag and thus accommodate the positioning of a bed pan.

For a full and more complete understanding of the invention, reference may be had to the following description and accompanying drawings wherein:

FIG. 1 is a vertical longitudinal section through the bed in which the body supporting assembly may be adjusted in relation to the base.

FIG. 2 is a transverse vertical section showing a higher elevation of one side of the whole body supporting assembly in combination of a more inflated side section of the the mattress like assembly of individually inflatable bags.

FIG. 3 is a vertical section showing the elevation of one side of a longitudinal divided body supporting assembly.

FIG. 4 is a longitudinal section through the bed with the middle support of a divided body supporting assembly resting on the base and the other pivotal connected supports partially elevated.

FIG. 5 is a modified embodiment with interposing panels and the bags for adjustment of the back, middle and leg supports in relation to each other positioned in a recess formed below the panel on which the body supporting assembly is mounted.

FIG. 9 is a diagramatic view of the conduit system with a selector valve and exhaust valve.

FIG. 10 is an elevation of a control panel with a selector valve and fluid inflow and outflow actuating buttoms for the adjustment of up to 10 inflatable bags.

FIG. 11 is a section through the control valve for the mattress like formation of inflatable bags and which includes a timer for causing automatic inflation of the bags in sequence.

FIG. 12 is perspective of the bed with a retracting toilet installed in its center.

FIG. 13 is a longitudinal view depicting the toilet in an out the way position and the mattress insert in position.

FIG. 14 is a sectional view of the bed of FIG. 4 adjusted for sitting up with the toilet bowl in position.

FIG. 15 is a perspective view of a bed with adjoining body supports embodying some of the inventions precepts.

DESCRIPTION OF A PREFERED EMBODIMENT

Figure 6:
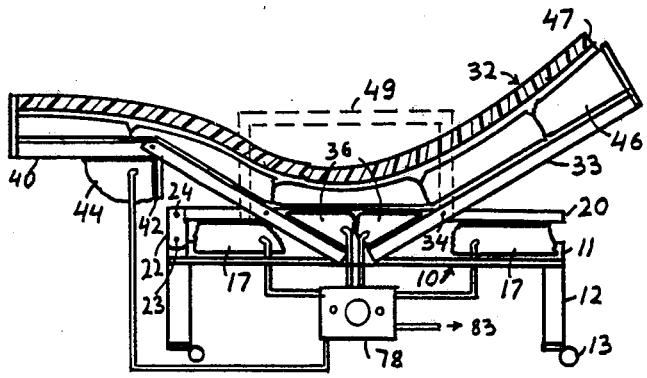
FIG. 6 is a longitudinal section of the bed of FIG. 4 with the modifications of an interposing panel linked to the base, the individually adjustable body support sections with a additional inflatable bag positioned below the leg support, and showing the mattress like assembly of inflatable bags with the conduits and the control panel shown enlarged for better understanding.

Refering now more particularly to FIGS. 1 and 2 adjustment for elevation of the body supporting assembly for height and for slope in a particular direction in relation to the base, will be described. A supporting base frame is generally designated 10. It comprises a horizontal member 11 from which depend legs 12. A caster 13 is carried at the lower end of each leg 12. At each end side member 11 is formed with transverse member 14 for positioning of inflatable bags 17. Placed over and extending somewhat over frame 10 and member 11 is the bottom member 15 of the body supporting assembly 32 resting on the inflatable bags positioned on transverse members 14.

It is evident that by inflating or deflating bags 17 trough the ports 18 member 15 with its body supporting assembly may be adjusted for height and for longitudinal and transverse incline in relation to the base 10.

It is a further evident that by inflation or deflation of a combination of 2 inflatable bags 17 at opposite ends on a same side on base (10) member 14 will provide adjustment of a longitudinal section of the body supporting assembly 32 by the inflatable bags 17 pressing against the section of the body supporting assembly.

Refering now to FIG. 4 the bed is shown with the body supporting assembly 32 comprising a backsupport 33 which is pivoted at 34 to a middle section 30 resting on member 11 of the base 10, a knee support 37 pivotally connected at 38 to the middle section 30, and a leg support 40 pivotally connected at 41 to the knee support 37.

It is evident that by inflation or deflation of bags 17 positioned on members 14 of base 10 the angle of the body supporting sections 32 and 37 can be adjusted.

MODIFICATION OF PREFERED EMBODIMENT

Figure 7:
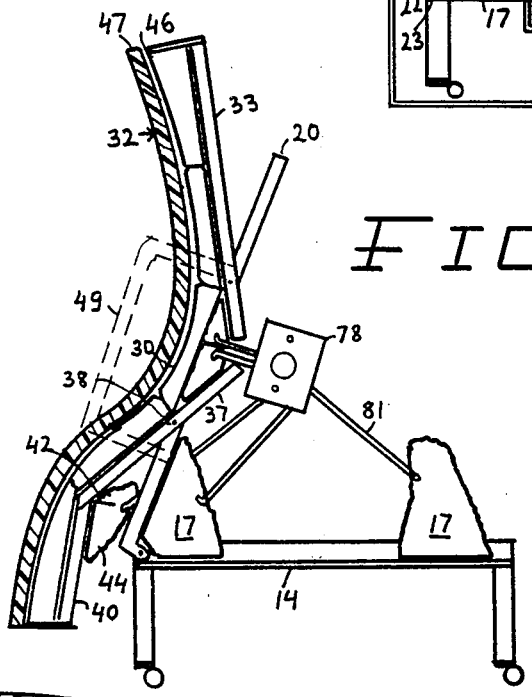
FIG. 7 is a longitudinal section of the bed of FIG. 6 when elevated into a near vertical position for the purpose of facilitating the incoming and outgoing of a handicapped occupant.

Refering now in particular to FIG. 6, a panel 20 is interposing between the base 10 and the body supporting assembly 32. The panel 20 is linked with members 22 at 24 and the base 10 at 23, the middle section 30 is mounted on the panel 20. The back support 3 is pivotally connected at 34 to the middle section 30 and the knee support 37 is pivotally connected at 38 to the other side of the middle section 30 and a leg support 40 is pivotally connected at 41 to the knee support 37. Inflatable bags 36 are positioned at pivotal connections of the supports 36 and 37 and provide for adjustment of these supports relativ to the middle support 30. An additional inflatable bag 44 is interposed between the leg support 40 and between member 42 extending at a right angle and rigid from the knee support 37 for adjustment of the leg support 40 relativ to the knee support 37. For additional adjustment and relief from pressures a mattress like formation of inflatable bags 46 covered by flexible material 47 is placed over the body supporting assembly 32. Adjustment of the body supporting assembly 32 relative to the base 10 and elevation of the body supporting supporting assembly for reclining, sitting and standing positions is accomplished by inflation or deflation of the bags 17 positioned on the base members 14, as also shown in FIG. 7.

PREFERED EMBODIMENT WITH TOILET FEATURE

Refering now in particular to FIGS. 13, 14 and 12, showing the added toilet feature to the embodiment of FIG. 4, a perspective of the bed is shown in FIG. 12. The retractable toilet insert is shown in position. FIG. 13 is longitudinal section trough the body supporting assembly 32 and the base 10. in the middle section 30 of the body supporting assembly 32 an opening 104 has been provided which is normally closed by an insert 103 composed of a mattress layer 106 and a support plate 107 suspended from the base frame members 11 by links 109 with a support 108 placed between the mattress layer 106 and the support plate 107. The links 109 are pivotally connected at 111 to the said base frame member 11 and to the suspended support plate 107 at 110 and permit the whole insert assembly 103 to be retracted downward and out of the way. The power means for returning the insert 103 to its normally closed position are provided in the form of a tubular bellow 112 connected to the base 10 at 114 and to the support plate 107 at 113, when the tubular bellow 112 is inflated the insert 103 moves upward and closes the opening 104, when the tubular bellow 112 is deflated, the insert 103 is retracted by means of coiled springs secured to the base 10 and to the support plate 107.

FIG. 14 is sectional view of the bed in a sitting up position with the toilet bowl 117 mounted on plate 118 in position in the opening 104. The support plate is suspended by links 119 from the base member 11 at 121 and secured to said plate 118 at 120. Power means for moving the toilet insert are provided by tubular bellows 122 anchored at 124 to the toilet insert assembly and at 123 to the base 10, moving the insert upward when inflated and retracting the inserts by coil springs.

THE SECOND EMBODIMENT

Referring now more particularly to FIG. 5 there is therein illustrated a frame 10 which is the same as the frame 10 of FIG. 1. Positioned above member 11 is a first horizontal panel 20 which is connected to member 11 by two pairs of links 22, there being a pair on each side. Each link 22 is connected to member 11 by a pivot 23 and its upper end to panel 20 by pivot 24. Depending from one end of panel 20 is an end member 25 that is rigid with respect thereto and spaced from frame 10. Inflatable bags 26 are interposed between frame 10 and end member 25 and are provided with the usual ports and tubes connected thereto.

It is evident that by inflating bags 26 panel 20 will be swung horizontally to the left speaking with reference to the showing of FIG. 5 and panel 20 elevated. By exhausting air from bags 26 panel 20 will swing to the right and fall downwardly. During these movements of panel 20 the latter is maintained horizontal and parallel to frame 10.

A second panel 27 is pivotally mounted at one end on panel 20 as indicated at 28. This second panel is formed with a recess 29 substantially mid-way its ends. The recess 29 opens downwardly and has a back 30 which partially defines the recess. This back 30 is an integral part of panel 27. Depending from back 30 substantially mid-way thereof is a partition 31. It is also notable that the recess 29 presents two open ends.

A body supporting assembly is indicated generally 32. It comprises a back support 33 which is pivoted at 34 to panel 27 thus providing an end portion 35 which extends through an open end of and into recess 29. One or more inflatable bags 36 are positioned in the chamber defined by back 30, partition 31, and end portion 35. This bag 36 has the usual port and tube extending therefrom to permit air to be charged thereinto under pressure or exhausted therefrom.

Assembly 32 also includes a middle support 37 which is pivoted at 38 to panel 27 thus providing an end portion 39 which extends into recess 29 through the open end at pivot 38. One or more bags 36 are positioned in the chamber defined by back 30, partition 31, and end portion 29.

Assembly 32 also includes a leg support 40 which is pivoted at 41 on one end of middle support 37. Depending from middle support 37 at 41 is a strip 42 which is rigid with respect to support 37. Another strip 43 is rigid with leg support 40. One or more inflatable bags 44 are interposed between strips 42 and 43 and thus by being inflated or deflated provide adjustment of leg support 40 relative to middle support 37.

It is evident that both bags 36 may be deflated to permit back support and middle support 37 to be substantially in alignment or that set of bags 36 and the chamber including end portion 39 deflated while the other set of bags 36 are inflated to cause the back support 33 to be up raised with respect to middle support 37. In either of these relative positions of back support 33 and middle support 37, panel 27 may be swung on pivot 28 by inflatable bag shown at 45 in a deflated condition. Thus, the assembly 32 is swung from a position correspond to that shown in FIG. 7 to that shown in FIG. 8.

Each of the sections 33, 37, and 40 of assembly 32 is covered by a plurality of inflatable bags 46 which may be assembled in mattress like formation and each of which has the usual port and tube connected thereto.

These bags 46 are covered by a layer of foam 47.

CONDUIT SYSTEM AND CONTROL PANEL

Figure 8:
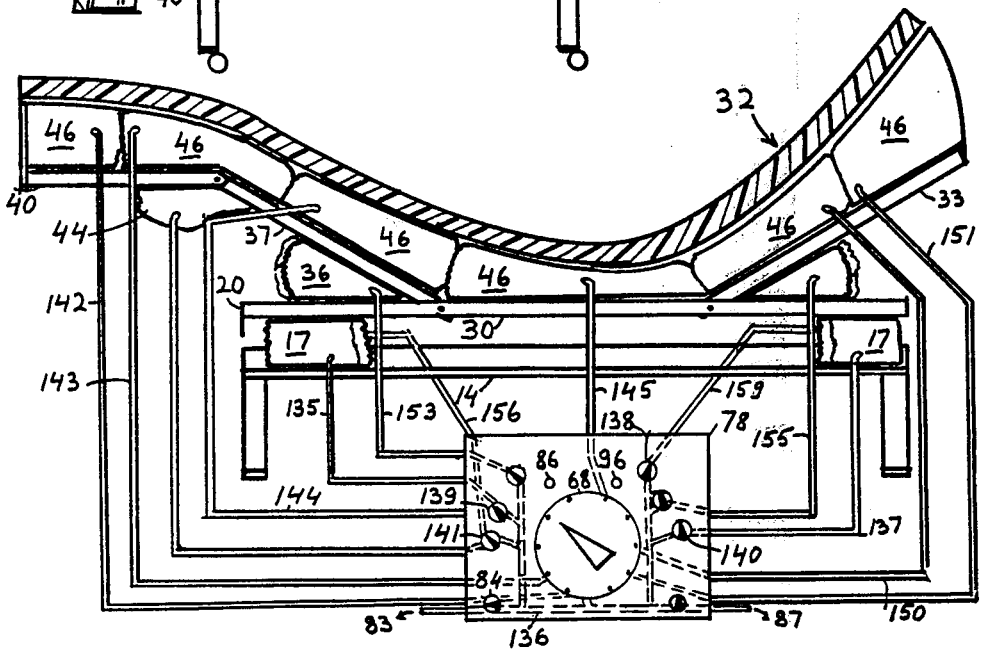
FIG. 8 is a enlarged view of the condiut system and the control valves and panel shown in a smaller scale in the preceeding figures, prepared in response to the office request for showing the actuating means and their connections to the actuating components.

Refering now in particular to FIG. 8 (new) which shows an embodiment of the bed with the interposing panel 20 and in an enlarged scale the conduit system and control panel 78. Fluid under pressure is flowing from the source 83 trough a valve 84 into a conduit connected to the opposite placed exhaust-valve 87. Activating the inflow button 86 connects the whole conduit system to the fluid source under pressure 83, and activating the outflow button 96 opens the exhaust valve 87. The flow continues trough 136 into selector valve 68 to the bags 46 of the inflatable mattress trough the conduits 142–151 and the outflow is accomplished by closing the inflow valve 84 and opening the outflow valve 87. In this case all selector valve connection are reserved for the adjustment of the inflatable mattress chambers. Adjustment for height or slope of the whole body supporting assembly is accomplished by opening the in or outflow of the inflatable bags 17 positioned on the base member 14 trough the respective valves 139,140 trough the conduits 152 and 154. The valves 139, 140 are connected to the in or outflow by conduits 135,137 and serve also in their respective second positions for the adjustment of the back support 33 by means of inflatable bags 36 positioned at the pivoting connection of said support to middle section 30, and for adjustment of the knee 37 support by means of bags 36 positioned at the pivoting connection to the middle support 30, trough conduits 153,155. The two additional bags 17 seen behind and beside the bags 17 are connected trough conduits 156,159 and valves 138 and 141 and are used for transverse adjustment. Valve 141 also serves in a second position the inflatable bag 44 for adjustment of the leg support 40 relativ to the knee support 37. Any required position adjustment and pressure relief is achieved by the respective valves and buttons.

Referring now more particularly to FIGS, 9, 10, and 11, a conduit system and control valve which may be used for the inflatable bags 46 and the mattress like formation or in the bellows like inflatable bags which control relative movement of the parts of the body supporting assembly and also movement of this assembly as an entirety with respect to the frame. A control valve is designated generally 68. It comprises a cylindrical casing 69 that is closed by end plates 70 and 71 (FIG. 11). Casing 69 is formed with a plurality of ports 72 from each of which extends a tube 73. There is a port 72 for each inflatable bag in the mattress like assembly. If the control valve is intended for use in conjunction with the bellows like bags there will be a port for each such bag and the tubes 73 will extend to the port of each such bag.

Rotatably mounted within casing 69 is a disc 74 having a passage 75 extending thereinto from the face adjacent to plate 71. This passage 75 communicates with a radial passage 76 which terminates in the periphery of the disc. A stub shaft 77 is driveably connected to disc 74, is journalled in an opening in plate 70 and thence passes through an opening in a face plate 78 where its free end is formed with an operating knob 79. The latter carries a pointer 80 which cooperates with indicia on face plate 78. A conduit 81 communicates at one end with passage 75 and is connected to a "T"]fitting 82. a compressor 83 is connected to one side of "T" fitting 82 with a one-way check valve 84 being interposed in the connection between "T" fitting 82 and check valve 84. Compressor 83 is energized by an electric motor (not illustrated) which is in turn connected to a source of power 85. An "on-off" switch is indicated at 86.

An exhaust valve is designated generally 87 and comprises a casing 88 having a central partition 89 formed with a valve seat 90 and providing an upper chamber 91 and a lower chamber 92. A pipe 93 has one end connected to "T" fitting 82 and the other end of upper chamber 91. A valve member 94 is mounted on a valve stem 95 which extends through the upper wall of casing 88 and has an operating knob 96 on its upper end. Valve member 94 is biased into closed position by an expansion coil spring 97. Lower chamber 92 of casing 88 is formed with an exhaust opening 98.

It is evident that with disc 74 adjusted to establish communication between conduit 81 and the port of any particular bag, and with exhaust valve 87 closed as it normally will be, switch 86 may be closed to energize compressor 83 and charge fluid under pressure into that bag. On the other hand, with switch 86 open member 96 may be depressed to open exhaust valve 87.

It is contemplated that the bags 46 of the mattress like formation may be automatically inflated or deflated in sequence and to accomplish this a timing motor is shown at 99 the drive shaft of which has a pinion 100 which meshes with a gear 101 that is driveably connected to disc 74.

To provide for automatic inflation and deflation of the bags of the mattress like assembly in sequential order, pinion 100 meshes with a gear 9 of a size much greater than gear 101. An eccentric cam 8 is driveably connected to gear 9 and is in wiping engagement with one end of a lever 7. Lever 7 is pivotally mounted between the ends as indicated at 6 and one end engages valve stem 95 and the other end engages a rod 5 which is included as a part of a normally open switch 4 which replaces switch 86. An expansion coil spring 3 normally biases lever 7 into a position in which valve 94 is seated on valve seat 90 to close the exhaust. With motor 99 in operation, cam 8 will hold exhaust valve 87 open for a complete cycle of the bags in which position switch 4 is closed. Thus as disc 74 rotates radial passage 76 will first approach one of the ports 72 to gradually open it and then finally close it. During this interim fluid under pressure will be charged into the particular bag for that port 72. This sequence will continue through a complete cycle during which all of the bags will have fluid under pressure introduced thereinto.

Cam 8 will depress valve stem 95 against the action of spring 97 and open exhaust valve 87. In this position rod 5 permits switch 4 to return to its normally open position. Thus, through another complete revolution of disc 74, the ports 72 will be in effective communication with the exhaust valve and the bags will have fluid exhausted therefrom in the sequential order above described.

Briefly summing up this phase of the operation, the bags first will inflate in sequential order through a complete rotation of disc 74 and then deflate through the following rotation of disc 74.

REMOVABLE TOILET

Referring now more particularly to FIGS. 12, 13, and 14, a bed 102 is shown as formed with an opening 103 which is of rectangular shape and the side walls 104 of which are flared downwardly. Bed 102 has a lower rigid panel 105 included in its construction. This opening 104 is normally closed by a mattress piece 106 as shown in FIG. 14. A plate 107 is suspended below mattress part 106 by arms 108. A pair of links 109 have their lower ends connected to plate 107 as indicated at 110 and their upper ends pivotally connected to rigid member 105 as indicated at 111. A flexible tube like expansible bellows 112 has one end connected to plate 107 as indicated at 113 and its other end to rigid member 105 as indicated at 114. This tubular bellows 112 may have a medium such as air or water applied thereto to expand it from a position indicated in FIG. 13 to the position of FIG. 14 to swing the mattress section 106 into position filling opening 104 and holding it in that position. A contraction coil spring 115 has one end anchored to rigid member 105 as indicated at 116 and its other end to plate 107 to hold the bed section 106 in an out of the way position.

A toilet bowl 117 is mounted on a plate 118 which is suspended from rigid member 105 by two pairs of links 119. The lower end of links 119 are pivoted to plate 118 at 120 and their upper ends to rigid member 105 at 121.

A flexible tubular bellows 122 has one end anchored to rigid member 105 as indicated as 123 and its other end to one of the links 119 as indicated at 124. A contraction coil spring 125 has one end anchored to plate 118 as indicated at 126 and its other to rigid member 105 as indicated at 127. Spring 125 normally holds toilet bowl 117 in an out of the way position such as when the opening 104 is occupied by mattress part 106. By introducing a proper medium into bellow 122 toilet bowl 117 is swung into the position illustrated in FIG. 13.

DOUBLE BED

FIG. 15 illustrates a double feature bed that includes two longitudinal sections which may be individually adjusted to suit the comfort of the occupant thereof. This double feature bed is designated generally 128. It comprises two sections 129 and 130 each of which includes a body supporting assembly substantially the same as that shown in FIGS. 7 and 8. Each section also includes a plurality of inflatable bags 46 which are connected in mattress like formation and covered by foam 47. The foam cover 47 for one bed section 129 may be connected to the foam cover for section 130 by a flexible sheet 131 at the head supporting sections on the bed. The section 130 of bed 128 includes an inner side portion 132 having one or more inflatable bags 133 beneath the foam layer 47 which are separately inflatable as compared to the remaining bags 46. Thus, these bags 133 may be deflated to cause the foam layer 47 to be depressed in the area of 132 and thus permit the insertion of a bed pan beneath the occupant.

While preferred specific embodiments of the invention are herein disclosed it is to be clearly understood that the invention is not limited to the exact constructions, mechanisms and devices illustrated and described because various modifications of these details may be provided in putting the invention into practice.

What is claimed is:

1. In an adjustable power tilted bed, (a) a base frame comprising a rectangular top and four legs depending from the corners thereof;

(b) a first panel mounted on said frame and movable relative thereto;

(c) power means for adjusting the first panel relative to said frame;

(d) a second panel pivoted at one end to an end of said first panel and formed with a central downwardly opening recess defined by an upper back and presenting open ends;

(e) a body supporting assembly comprising a back support, a knee support, and a leg support;

(f) a pivotal connection between said back support and said second panel at one end of said recess whereby an end portion of said back support extends into said recess;

(g) power means between the back of said recess and said end portion for adjusting said back support relative to said second panel;

(h) a pivotal connection between said knee support and the second panel at the other end of said recess whereby an end portion of said middle support extends into said recess;

(i) power means between the back of said recess and the end portion of said knee support for adjusting said middle support relative to said second panel;

(j) a pivotal connection between said leg support and said knee support at the end of the latter remote from its pivotal connection to said second panel.

2. The adjustable bed of claim 1 in which the second panel is connected to the first panel by two pairs of links arranged with one link of each pair on one side of the panels and one link of each of the other pair on the other side of the panel with one end of each link being pivoted to a panel, together with an end piece rigidly connected to said first panel and depending therefrom in confronting relation to said frame; and the power means for adjusting the first panel relative to said frame takes the form of an inflatable bag between said end piece and said frame.

3. The adjustable bed of claim 1 in which the power means for adjusting the positions of the back and knee supports relative to the second panel takes the form of inflatable bags positioned in said recess between the back thereof and the end portions of said back and knee supports.

4. A mattress like formation composed of at least 6 adjoining individually inflatable chambers, formed, exept for the head or foot serving portions, by at least two chambers in every transverse alignement, and covered by flexible material, provided with a conduit and control system for individual adjustment, including a manuel or power and sequented rotary selector valve, linked to an exhaust and a fluid source under pressure such as an compressor.

5. The adjustable bed of claim 3 in which the power means for adjusting the leg support relative to said middle support comprises a rigid member connected to each of the leg and middle supports at the pivotal connection therebetween and an inflatable bag between said rigid members.

6. The adjustable bed of claim 5 together with a mattress like assembly of inflatable bags covering said back, middle, and leg supports and a layer of foam material over said mattress like assembly.

7. An adjustable bed having a body supporting assembly resting on a panel and base and provided with inflatable bags which by inflation or deflation adjust the position of the occupant and cause the various movements of the body supporting assembly, the panel and base in relation to each other and including:

(a) a conduit system connecting the inflatable bags individually to a fluid source through an individually adjustable valve system;

(b) a source of fluid under pressure;

(c) a control panel provided with the means to open the flow of fluid under pressure from the source in an adjustable manner to each inflatable bag individually and to exhaust therefrom.

8. The bed of claim 7 wherein said inflatable bags take the form of two pairs of individually inflatable bags positioned at opposite sides on the base and supporting the body supporting assembly resting with its bottom members on said bags, whereby the body supporting assembly can be adjusted for level in relation to the base and the angle of the body supporting assembly and its sections by inflation or deflation of any respective combination of the four bags forming said two pairs, and whereby the occupant can be positioned for height, slope and angle.

9. The bed of claim 8 wherein the sections of the body supporting assembly comprise a middle support, a backsupport pivoted on one end of said middle support, a knee support pivoted to the second end of said middle support, a leg support pivoted to the second end of said knee support, and the body supporting assembly is covered by mattresses like assembly of inflatable bags, whereby the position of the occupant can be adjusted by movements of body supporting section by inflation and deflation of the inflatable bags on which the body supports rest, and by changing the pressure of any of the individually adjustable bags of the mattress like assembly separately and in sequence.

10. An adjustable bed with with a first conduit system including a control valve for charging fluid under pressure selectively into, or exhausting fluid from the inflatable bags which adjust the position of the first panel relative to the second panel and the inflatable bags which adjust the back and leg supports relative to the second panel and the middle and leg supports relative to each other and a second system of conduits including a control valve for selectively charging air under pressure into or exhausting air from the inflatable bags of the mattress like assembly.

11. The adjustable bed of claim 10 in which the conduit system includes mechanism for automatically charging fluid under pressure into the inflatable bags of said mattress like assembly in sequential order through a complete cycle of all of said bags and then exhausting fluid automatically from the bags in sequential order through another complete cycle following the first said cycle.

12. A body-supporting assembly and base between the body supporting assembly and the base member nesting on the floor, and the body supporting assembly mounted with its middle support section on that panel, and the position of the panel and the body supporting assembly adjustable in relation to the base by inflation or deflation of inflatable bags between the base and the panel, and (a) an inflatable bag placed between the panel and the back support at its pivotal connection to the middle support and operable under inflation or deflation for adjustment of said backsupport relative to said middle support;

(d) a second inflatable bag placed between the panel and between said knee support at its pivotal connection to said middle support, and operable under inflation and deflation to adjust the knee support relative to the middle section;

a third inflatable bag positioned below the leg support at its pivotal connection with the knee support, and operable under inflation or deflation for adjustment of the leg support relative to the knee support.

13. In a body supporting assembly (a) centrally located aligned openings in the middle support and in the mattress layer;

(b) a support and mattress section normally filling said openings as inserts from below provided with retracting means;

(c) two pairs of links pivotally connected at on end on both sides of the insert support and on the other end to panel holding the body supporting assembly;

(d) power means for swinging said insert support and mattress layer downwardly and laterally into an out of the way position and holding it in that position, and said power means including mechanism for swinging said insert support and mattress layer from out of the way position into a position in which said insert support and mattress layer occupies said openings in the middle support and body supporting assembly;

(e) a toilet bowl mounted on a second insert support to be received into the openings vacated by the first insert support and its mattress layer and provided with retracting means (f) Connecting means such as two additional pairs of links arranged with one pair on one side of said second insert support to which the lower ends of the links are pivotally connected and the other pair on the second side of said second insert support to which the lower ends of the links are pivotally connected.

14. The adjustable bed of claim 13 in which both of the power means for swinging the mattress insert and the toilet bowl insert into and out of position occupying said opening and holding them in such positions or in and out of the way comprises a pair of contracting springs each having one end anchored to the base plate of the insert and the other end to a rigid part of the bed assembly, and a pair of flexible tubular bellows each being secured on one end to said insert base plate and the other end to a rigid part of the bed assembly and the movements of the inserts being caused by inflation or deflation of the tubular bellows activated by remote control.

15. In a adjustable bed wherein the body supporting assembly is made up of 3 longitudinal sections, a center section and two side sections each pivotally connected to its side of the center section, the side sections being adjustable by power means such as inflation and deflation of the inflatable bags on which the respective sections rest.

16. In an adjustable bed wherein the body supporting assembly is made up of a middle section, two adjacent back sections pivotally connected to said middle section, two adjacent knee sections pivotally connected to the second side of the middle section, and two parallel leg sections pivotally connected to the second side of the knee section, and the body supporting - assembly covered by flexible material to bridge the gaps between the adjoining support-sections when they are adjusted separately for double occupancy and for individual limb positioning after surgery or treatment, the remote controlled adjustments of the individual supports being caused by means such as inflation and deflation of inflatable bags on which the respective sections rest.

* * * * *

UNITED STATES PATENT OFFICE

CERTIFICATE OF CORRECTION

Patent No. 4,127,906 Dated December 5, 1978

Inventor(s) Henry C. Zur

It is certified that error appears in the above-identified patent and that said Letters Patent are hereby corrected as shown below:

Column 13, line 48, after "base" should read -- wherein a panel interpose --.

Column 14, line 9, before "two" should read -- (c) connecting means such as --.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,127,906

DATED : December 5, 1978

INVENTOR(S) : Henry C. Zur

It is certified that error appears in the above-identified patent and that said Letters Patent are hereby corrected as shown below:

Column 13, line 48, after "base" insert --wherein a panel interposes--.

line 49, "member" should read --members--.

line 50, "nesting" should read --resting--.

Column 14, line 9 , before "two" insert --connecting means such as--.

This certificate supersedes Certificate of Correction issued March 27, 1979.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*